US008061561B1

(12) United States Patent
Chang

(10) Patent No.: US 8,061,561 B1
(45) Date of Patent: Nov. 22, 2011

(54) PRODUCT HOLD DOWN ANCHOR, UNIT AND MECHANISM FOR A MERCHANDISE STORING AND DISPENSING HEAD OF A VENDING MACHINE

(76) Inventor: Kil Jae Chang, Anyang (KR)

( * ) Notice: Subject to any disclaimer, the term of this patent is extended or adjusted under 35 U.S.C. 154(b) by 503 days.

(21) Appl. No.: 12/221,259

(22) Filed: Aug. 1, 2008

Related U.S. Application Data

(60) Provisional application No. 61/131,350, filed on Jun. 6, 2008.

(51) Int. Cl.
*G07F 11/00* (2006.01)

(52) U.S. Cl. ..... 221/279; 221/92

(58) Field of Classification Search ..... 221/208, 221/241, 244, 268, 279, 281
See application file for complete search history.

(56) References Cited

U.S. PATENT DOCUMENTS

| | | | | | |
|---|---|---|---|---|---|
| 251,296 | A | | 12/1881 | Rushforth | |
| 340,355 | A | | 4/1886 | Ramser | |
| 409,571 | A | * | 8/1889 | Fischer | 221/244 |
| 892,687 | A | | 7/1908 | Schrum | |
| 1,169,775 | A | | 2/1916 | Cornwall | |
| 1,171,478 | A | * | 2/1916 | Tintera | 194/294 |
| 1,466,372 | A | | 8/1923 | Giles | |
| 1,517,377 | A | * | 12/1924 | Mortensen | 194/296 |
| 1,697,510 | A | | 1/1929 | Morin | |
| 1,754,527 | A | * | 4/1930 | Rowe | 312/321.5 |
| 2,784,872 | A | | 3/1957 | Lux | |
| 2,990,084 | A | | 6/1961 | Probasco | |
| 3,270,915 | A | | 9/1966 | Auer | |
| 3,734,344 | A | * | 5/1973 | Teichelman | 221/14 |
| 4,109,825 | A | | 8/1978 | Weitzman | |
| 4,133,421 | A | * | 1/1979 | Hanley et al. | 194/257 |
| 5,261,564 | A | | 11/1993 | Yelvington | |
| 5,472,074 | A | | 12/1995 | Milcetic | |
| 5,829,631 | A | | 11/1998 | Kasper | |
| 6,502,719 | B2 | * | 1/2003 | Huang | 221/227 |
| 2004/0149770 | A1 | * | 8/2004 | Huang | 221/268 |
| 2005/0000978 | A1 | * | 1/2005 | Huang | 221/279 |
| 2005/0077311 | A1 | | 4/2005 | Chang | |

* cited by examiner

*Primary Examiner* — Leslie A Nicholson, III
*Assistant Examiner* — Kelvin L Randall, Jr.
(74) *Attorney, Agent, or Firm* — John R. Flanagan

(57) ABSTRACT

A product hold down unit has a vertical column of a carousel and a vertical row of spaced-apart engageable elements on the column. The column has a compartment open at opposite top and bottom ends and adapted to receive product items in a vertical stack. The row of engageable elements extends between the top and bottom ends of the column, enabling restriction of items in the compartment to moving from top to bottom ends of the compartment but not vice versa. The unit also has an anchor resting on top of, and supported by, the stack in the column compartment as the anchor engages adjacent ones of the engageable elements on the column so as to prevent it from moving upwardly in the compartment while allowing it to move downwardly by gravity as product items are dispensed from the stack thereof at the bottom end of the column.

8 Claims, 8 Drawing Sheets

PRODUCT HOLD DOWN ANCHOR, UNIT AND MECHANISM FOR A MERCHANDISE STORING AND DISPENSING HEAD OF A VENDING MACHINE

This patent application claims the benefit of U.S. provisional application No. 61/131,350 filed Jun. 6, 2008.

CROSS-REFERENCE TO RELATED APPLICATION

Cross reference is hereby made to a related co-pending U.S. patent application Ser. No. 12/009,707 filed Jan. 22, 2008 by the same inventor. The disclosure of this co-pending patent application is hereby incorporated herein by reference.

BACKGROUND OF THE INVENTION

The present invention generally relates to vending machines and, more particularly, is concerned with a product hold down anchor, unit and mechanism for a merchandise storing and dispensing head of a vending machine.

One general type of prior art vending machine, that has been manufactured and sold heretofore by the inventor herein, includes a merchandise storage and dispensing head, a housing supporting the head, and a coin-operated actuation mechanism mounted on and extending into the interior of the housing to where the actuation mechanism operably engages a dispensing wheel on the bottom of the head and rotates it to dispense items of product via a delivery chute to an external location on the housing in response to deposit of a coin by a user in the actuation mechanism and turning of a handle of the actuation mechanism by the user. The vending machine also has a coin box disposed in a base of the housing below the actuation mechanism and dispensing wheel for receiving the coin from the operation of the actuation mechanism that was deposited in the actuation mechanism by the user.

In one particular version of this prior art vending machine, the merchandise storage and dispensing head includes a rotary carousel with a merchandise holding magazine formed by a plurality of product storing and stacking tubular receptacles or columns arranged in a circular row and mounted on a circular bottom plate of the carousel. Product items are dispensed from the lowermost end of the stacks thereof in the columns through the bottom plate when the carousel is rotated so as to bring each of the columns successively into alignment over a dispensing opening in a stationary platform below the carousel which is mounted on the upper end of the housing. The dispensing wheel is located below the stationary platform but fixedly coupled to the bottom plate of the carousel and drivingly engaged by the actuation mechanism so as to rotate and carry with it the carousel in response to the user depositing a coin in the actuation mechanism and turning the handle thereon.

This particular vending machine has been subjected to abuse by vandals who attempt to steal items from the machine by inverting and shaking it so as to attempt to dislodge the items stacked in the columns. They try to scatter these items from their stacked and confined locations in the columns so that some might find their way through the dispensing opening in the stationary platform and through the dispensing wheel into the discharge chute without depositing any coins in the actuation mechanism and turning the actuating handle of the mechanism. Most of these attempts to pilfer items from the machine in this manner end in failure but do oftentimes result either in damage to the machine or render the machine out of operative condition until serviced by the owner. This results in a loss of opportunity for the machine to earn revenue for its owner.

Consequently, a need exists for an innovation which will provide a solution to the aforementioned problems in the art without introducing any new problems in place thereof.

SUMMARY OF THE INVENTION

The present invention provides a product hold down anchor, unit and mechanism for the merchandise storing and dispensing head of the vending machine which is designed to satisfy the aforementioned need. The product hold down mechanism of the present invention includes a plurality of the hold down units which are independent of one another and provide separate hold down anchors adapted to be supported on the top of the stacks of product items in the respective columns of the carousel in conjunction with vertical rows of vertically spaced apart engageable elements on the columns so as to provide an effective solution to the vandalism and pilfering problem that is an alternative to the solution provided by the ring-supported plurality of platens of the hold down mechanism of the above cross-referenced patent application. Also, when a particular column becomes empty of product items, the individual anchor for that column is adapted to extend through the bottom plate of the carousel and into the dispensing opening in the stationary platform below the carousel so as to stop and block the carousel from further movement so that users will be prevented from turning the knob to advance the carousel when the one of the columns aligned with the dispensing opening is empty of product items. In effect, each hold down unit, in addition to preventing displacement of product items from its column upon inversion of the vending machine, will also prevent continued operation of the vending machine when its respective column becomes empty so that users will not become frustrated and upset when no product is dispensed after they insert their coins into the machine and turn the handle far enough to prevent retrieval of the coins.

Accordingly, the present invention is directed to a product hold down unit for a merchandise storing and dispensing head of a vending machine. The product hold down unit includes a tubular storage column of a carousel having a plurality of the columns and a vertical row of vertically spaced apart engageable elements on the column. The column defines a compartment and is open at opposite top and bottom ends and adapted to receive product items in a vertical stack in the compartment. The engageable elements are defined on and extend between the top and bottom ends of the column, enabling product items in the compartment to be restricted to moving from the upper end toward the bottom end of the compartment but not vice versa. The product hold down unit also includes a hold down anchor adapted to be lowered into the compartment of the column through the open top end thereof, to rest on top of and be supported by, the stack of product items in the column compartment, and engage one at a time a selected engageable element in the vertical row thereof that is adjacent to the hold down anchor such that the anchor can move by gravity downward toward the bottom end of the column but cannot move toward the top end of the column.

The present invention is also directed to a product hold down mechanism for the merchandise storing and dispensing head of the vending machine. The product hold down mechanism includes a plurality of the above-described product hold down units. Each unit is associated with one of the plurality of tubular storage columns of the carousel of the merchandise storing and dispensing head.

The present invention is further directed to the product hold down anchor for the merchandise storing and dispensing head of the vending machine. The product hold down anchor includes a platen body adapted to be lowered into the compartment of the tubular storage column through the open top end thereof and rest on top of and be supported by the stack of product items in the vertical compartment of the tubular column. The anchor also includes an one-way ratchet member coupled to the platen body and selectively engageable one at a time with and disengageable from one of the engageable elements in at least one vertical row thereof on the tubular column that are adjacent to the platen body allowing the hold down anchor to move by gravity downward toward the bottom end of the column but not move toward the top end of the column.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
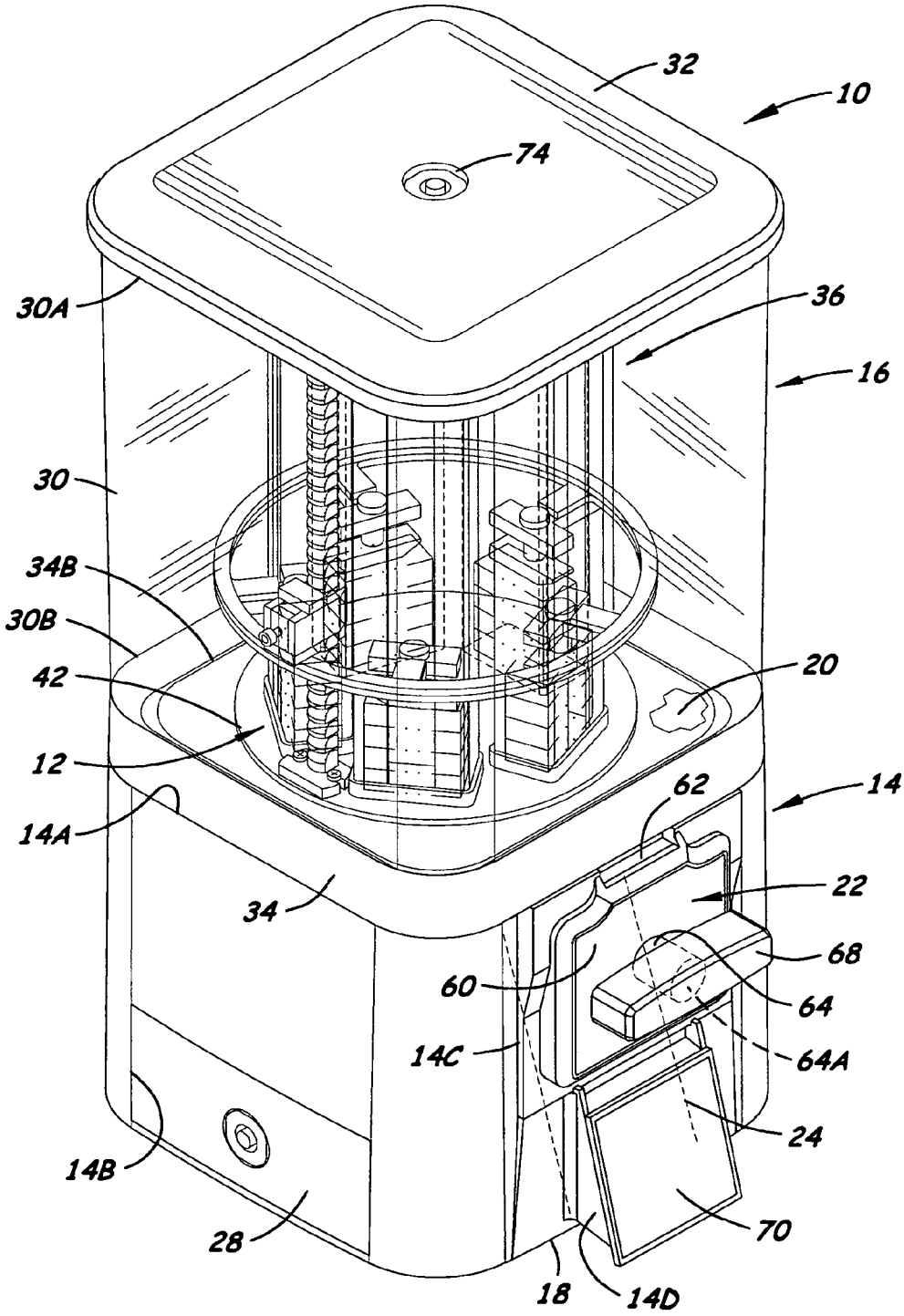
FIG. 1 is a perspective view of a vending machine in which is installed a merchandise hold down mechanism of the cross-referenced patent application and to which a product hold down anchor, unit and mechanism of the present invention can be applied to replace the depicted merchandise hold down mechanism.
Figure 2:
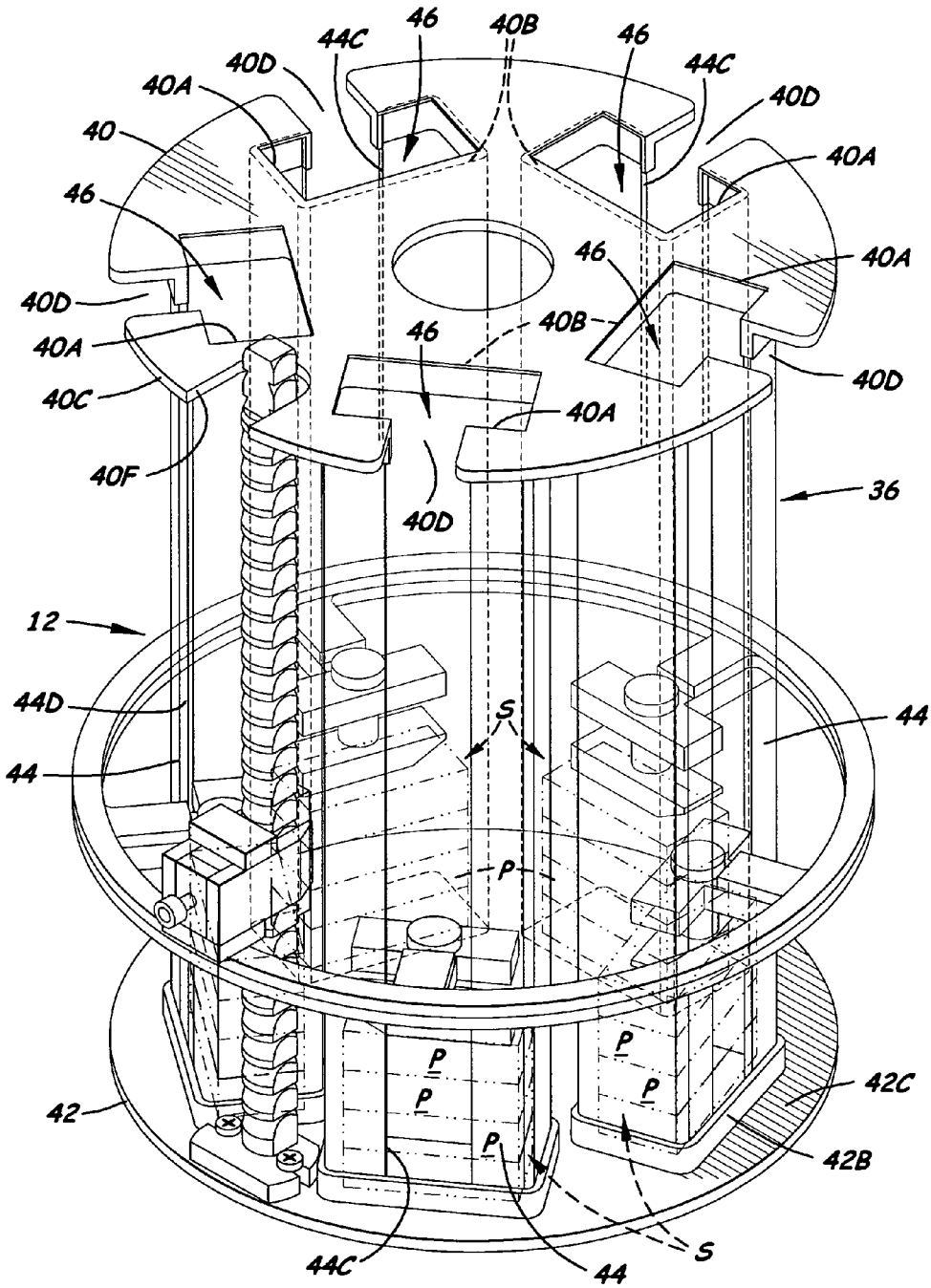
FIG. 2 is an enlarged perspective view of the merchandise carousel removed from the vending machine of FIG. 1 to better illustrate the installation therein of the hold down mechanism of the cross-referenced patent application.
Figure 3:
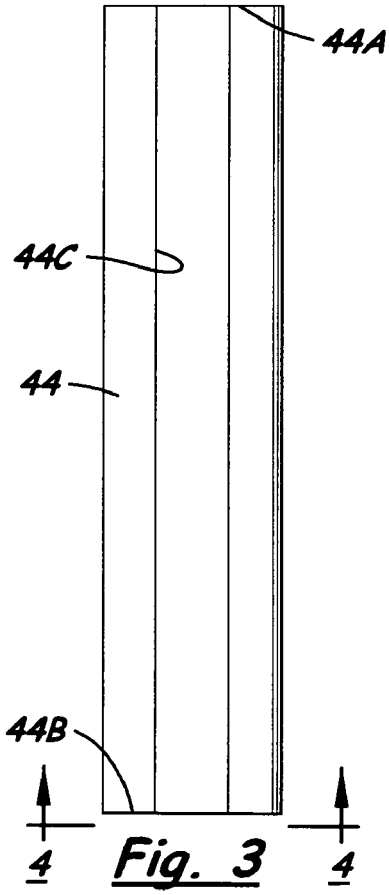
FIG. 3 is an enlarged elevational view of one of the storage columns of the carousel of FIG. 2 which has an overall rectangular configuration.
Figure 5:
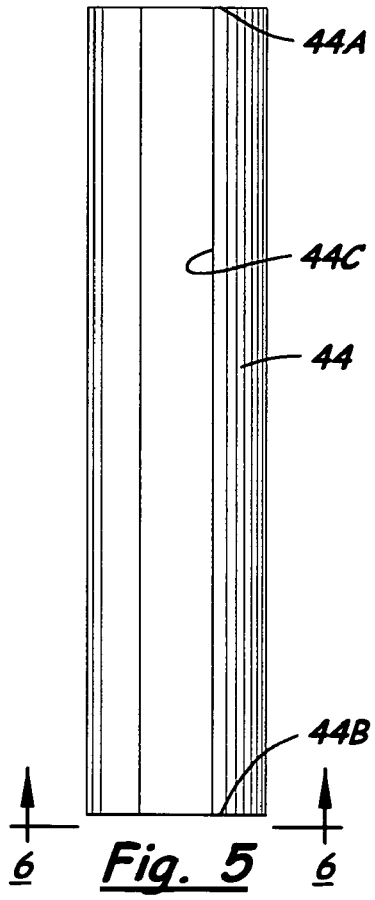
FIG. 5 is an elevational view similar to that of FIG. 3 but of an alternative storage column having an overall cylindrical configuration.
Figure 4:
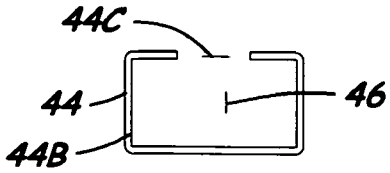
FIG. 4 is a bottom view of the storage column as seen along line 4-4 of FIG. 3 to illustrate the rectangular configuration of the storage column.
Figure 6:
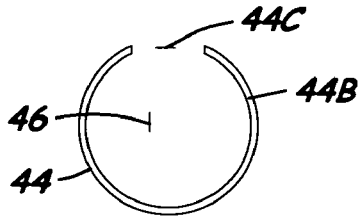
FIG. 6 is a bottom view of the storage column as seen along line 6-6 of FIG. 5 to illustrate the cylindrical configuration of the storage column.

Referring to the drawings and particularly to FIGS. 1 and 2, there is illustrated an exemplary embodiment of a prior art coin-operated vending machine, generally designated 10, in which is advantageously incorporated a merchandise hold down mechanism, generally designated 12, which is the subject of the invention disclosed in the above cross-referenced co-pending patent application by the same inventor as herein. The present invention encompasses a product hold down unit and mechanism described later on which replaces the merchandise hold down mechanism 12 in the vending machine 10. Before describing the hold down unit and mechanism of the present invention, the vending machine 10 (without the merchandise hold down mechanism 12) will first be described with reference to FIGS. 1 and 2.

Basically, the vending machine 10 includes a housing 14 and a merchandise storage and dispensing head 16 supported upon the housing 14. The housing 14 preferably, but not necessarily, is rectangular in configuration and has an open top end 14A, a closed bottom 18 and an interior chamber 20 extending therebetween. The vending machine 10 also includes a coin-operated actuation mechanism 22 and a discharge chute 24 supported by the housing 14, an elongated assembly rod 26 (see FIG. 7) extending vertically through the interior chamber 20 of the housing 14 and interconnecting and locking the housing 14 and head 16 together, and a lockable coin box 28 disposed in the interior chamber 20 of the housing 14 upon the closed bottom 18 thereof and when unlocked removable through a side opening 14B in the housing 14.

The merchandise storage and dispensing head 16 of the vending machine 10 includes an outer transparent enclosure 30 preferably, but not necessarily, rectangular in overall configuration, a removable cap 32 fittable upon an open upper end 30A of the enclosure 30 to close the same, and a top cover or platform 34 removably supported on the open top end 14A of the housing 14 to close the same. The platform 34 removably seats and closes the outer enclosure 30 at its lower open end 30B within an interior peripheral recess 34B formed in the platform 34. The head 16 of the vending machine 10 also includes a generally cylindrical-shaped magazine or carousel 36 disposed in the outer transparent enclosure 30, below the removable cap 32 and above the platform 34, and a dispensing mechanism 38 (FIG. 7) disposed below the platform 34 and fastened to the carousel 36 via a central boss 34A defined in the platform 34.

Referring now to FIGS. 1-7, the carousel 36 of the head 14 includes upper and lower plates 40, 42 and a plurality of elongated tubular storage receptacles or columns 44 defining product receiving and stacking compartments 46 therein. The storage columns 44 are mounted upright in relation to, and extend between, the upper and lower plates 40, 42. The storage columns 44 are displaced angularly from each other in a substantially endless circular arrangement or row. As can be understood with respect to two exemplary forms of the carousel 36 shown in FIGS. 3-4 and 5-6 of the drawings, the columns 44 and their respective compartments 46 can have rectangular or circular cross-sectional configurations for accommodating and holding therein a stack S of products or items P, such as flat mints or the like, being correspondingly rectangular or circular in configuration. The compartments 46 of the storage columns 44 open at the tops and bottoms 44A, 44B of the columns 44. The columns 44 also have elongated slots 44C defined in outwardly facing side portions of the columns 44, opening into the compartments 46 and extending lengthwise between and opening at the open tops and bottoms 44A, 44B of the columns 44. The upper and lower plates 40, 42 have respective pluralities of holes 40A, 42A defined therethrough, rims 40B, 42B formed on facing surfaces 40C, 42C of the plates 40, 42 and outwardly-facing slots 40D defined in the upper plate 40 and rims 40B. The holes 40A, 42A with their associated rims 40B, 42B are angularly displaced from one another and of a size and arrangement matching that of the open tops and bottoms 44A, 44B of the storage columns 44 such that the opposite open tops and bottoms 44A, 44B of the storage columns 44 tightly interfit with the rims 40B, 42B of the upper and lower plates 40, 42. The holes 40A, rims 40B and slots 40D of the upper plate 40 together with the open tops 44A of the storage columns 44 facilitate by use of one's hand, and thus manually, placing and stacking of the items P in the storage columns 44, whereas the open bottom 44B of the storage columns 44 facilitate resting the stacks S upon a top surface of the platform 34 and successive discharging of such items P one at a time from the bottom of the stacks S from the storage columns 44 through a dispensing passage 37 (FIG. 8A) in the platform 34.

Figure 7:
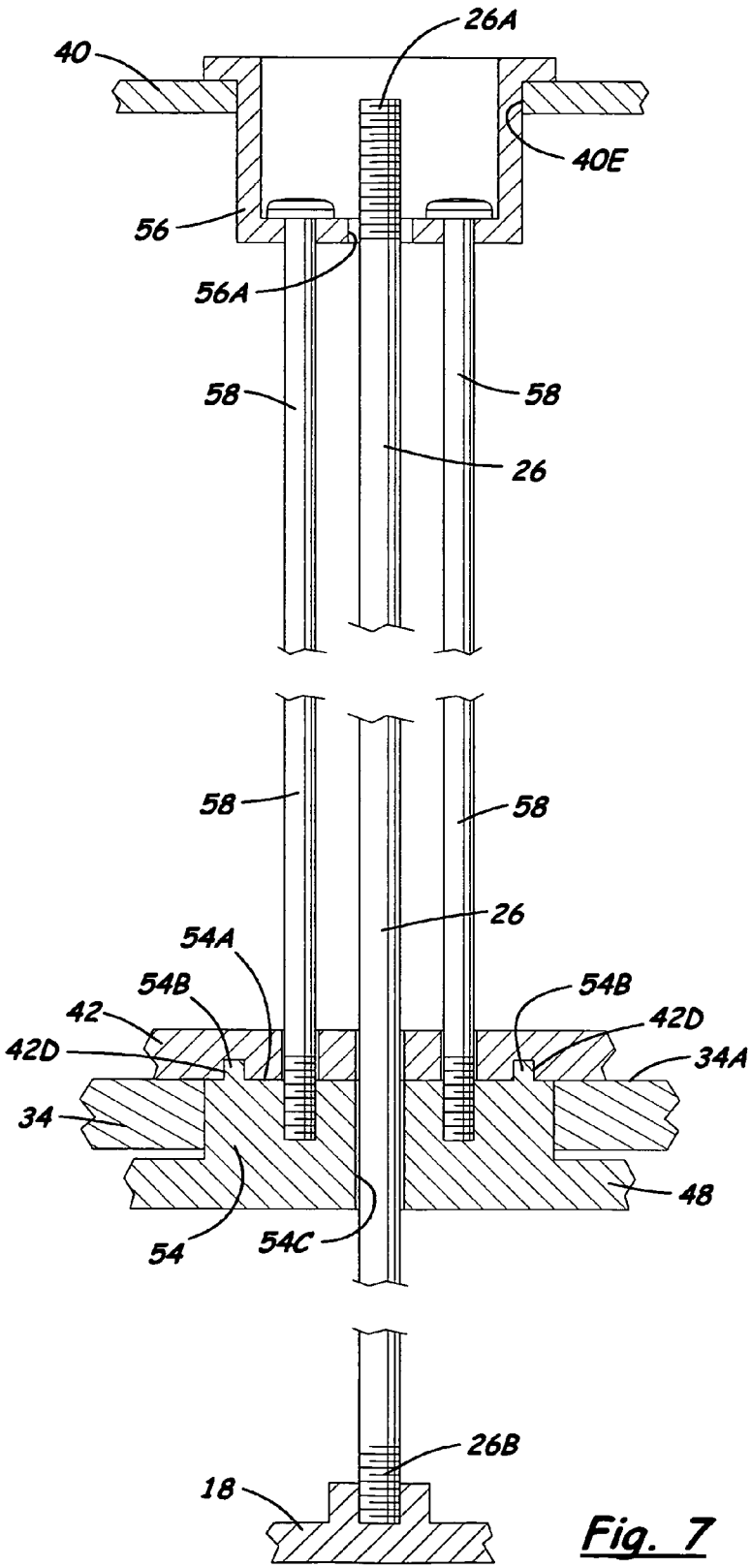
FIG. 7 is an enlarged fragmentary foreshortened view of components of the machine which fixedly secure the carousel upon the dispensing wheel.

As seen in FIG. 7, a dispensing wheel 48 (partially shown) of the dispensing mechanism 38 is located below the platform 34. The lower plate 42 of the carousel 36 is located above the platform 34. The two are fixedly interconnected to one another at central locations thereon by a centrally-located lower cylindrical connector 54 which is formed on the dispensing wheel 48 and projects upwardly through the central boss 34A in the platform 34, a centrally-located upper cylindrical connector 56 seated through a central opening 40E in the upper plate 40 of the carousel 36, and a pair of tie rods 58 which are inserted through the upper connector 56 and fastened to the lower connector 54 so as to clamp the carousel 36 upon a top surface 54A of the lower connector 54 and thus, in effect, upon the dispensing wheel 48. There is also a plurality of upwardly projecting studs 54B provided on the top surface 54A of the lower connector 54 which interfit in a matching plurality of apertures 42D defined in the lower plate 42 of the carousel 36 when the lower plate 42 is resting upon the top surface 54A of the lower connector 54. The interfitting relationship of the studs 54B with the apertures 42D prevents any tendency for the carousel 36 to twist relative to the lower connector 54 upon rotation of the dispensing wheel 48 by operation of the actuation mechanism 22. In such arrangement, the carousel 36 and the dispensing wheel 48 are fastened together and rotatable in unison with one another relative to the stationary platform 34 of the head 16.

As seen in FIG. 1, the coin-operated actuation mechanism 22 is mounted to and supported by the housing 14 so as to occupy a front slot 14C defined in the housing 14 and open at the open top 14A of the housing 14. In such position, the actuation mechanism 22 extends both within and without the housing 14. The actuation mechanism 22 includes a mounting structure 60 mounted within the front slot 14C so as to define a top coin deposit slot 62 and also include a central drive shaft 64 mounted through the mounting structure 60 for rotation about an axis extending in a generally orthogonal relation to a central axis of the head 16 which is coaxial with the elongated assembly rod 26. The actuation mechanism 22 further includes a drive gear (not shown) attached to an inner end of the drive shaft 64 for undergoing rotation therewith. The drive gear is disposed in the interior chamber 20 of the housing 14 below and intermeshed with the dispensing wheel 48 such that rotation of the drive gear with the drive shaft 64 will cause rotation of the dispensing wheel 48 and carousel 36 relative to the platform 34. The actuation mechanism 22 still further includes a knob 66 attached to an other end 64A of the drive shaft 64 such that upon deposit by a user of a given coin in the top coin deposit slot 62 in the mounting structure 60 of the actuation mechanism 22 and by the user turning the knob 66 through one revolution, the drive shaft 64 and drive gear are rotated and cause the dispensing wheel 48 and carousel 36 to rotate through a given dispensing cycle permitting the dispensing of one item into the discharge chute 24 and through the discharge chute 24 to a discharge outlet 14D on the housing 14. The discharge outlet 14D is covered by a pivotal door 68 by the lifting of which a user can gain access to an item P of merchandise dispensed by the operation of the vending machine 10.

As seen in FIG. 7, the assembly rod 26 is extendible through the head 16 (and thus through central holes 54C, 56A through the lower and upper connectors 54, 56 respectively of the dispensing mechanism 38 and the carousel 36) and the housing 14 and connectible at respective lower and upper ends 26A, 26B to the housing 14 and the removable cap 32 for lockably interconnecting them together with the remainder of the head 16 clamped therebetween. Thus, the assembly rod 26 holds the vending machine 10 in an assembled condition but permits its disassembly and the removal of the carousel 36 and the dispensing mechanism 38 of the head 16 and the platform 34 therewith, as a unit, from the housing 14. The assembly rod 26 is attached at its lower end 26A to the closed bottom 18 of the housing 14 and extends upwardly through the housing 14, lower connector 54 fo the dispensing wheel 48, platform 34, upper connector 56 of the carousel 36, and removable cap 32 to the upper end 26A of the assembly rod 26. The upper end 26A can be lockably secured by a lock mechanism 70 for assembling and clamping the enclosure 30 and platform 34 of the head 16 between the housing 14 and the cap 32 with the carousel 36 rotatably mounted on the platform 34 and drivingly meshed with the drive gear of the actuation mechanism 22.

Thus, all components of the vending machine 10, with the exception of the mechanism 12, which have been described up to this point with reference to FIGS. 1-7 are well-known in the prior art.

Turning now to FIGS. 8-17, there is one exemplary embodiment of one of a plurality of the product hold-down units 72 that make up a product hold down mechanism 74 of the subject invention. The mechanism 74, employed in the vending machine 10 in place of the merchandise hold down mechanism 12, includes the plurality of tubular storage columns 44 of the carousel 36 of the merchandise storing and dispensing head 16 and the plurality of product hold down units 72 each associated with one of the columns 44 of the carousel 36. Each column 44 defines a vertical compartment 46 and is open at opposite top and bottom ends 44A, 44B of column 44 and is adapted to receive product items P in a vertical stack S in the compartment 46. The columns 44 also have elongated slots 44C defined in outwardly facing side portions of the columns 44, opening into the compartments 46 and extending lengthwise between and opening at the open tops and bottoms 44A, 44B of the columns 44.

As mentioned above, the hold down mechanism 74 also includes the plurality of product hold down units 72 each associated with one of the plurality of tubular storage columns 44 of the carousel 36. Each hold down unit 72 includes a vertical row 76 of spaced apart engageable elements 78 defined on and extending between the top and bottom ends 44A, 44B of the one tubular column 44, enabling restriction of product items P in the vertical stack S thereof in the compartment 46 to moving from the top end 44A toward the bottom end 44B of the compartment 46 but not vice versa. Each column 44, as described earlier, has a pair of vertical sidewalls 44D, 44E and an inner rear wall 44F interconnecting the sidewalls 44D, 44E and providing the column 44 with a generally U-shaped cross-sectional configuration. The vertical sidewalls 44*d*, 44E define the outer lengthwise slot 44C which opens into the compartment 46 defined in the tubular column 44. The engageable elements 78 are affixed or formed in any suitable manner to the one vertical sidewall 44E adjacent to the slot 44C and extends between the top and bottom ends 44A, 44B of the column 44. In the one exemplary embodiment, the engageable elements 78 are a series of vertically spaced downwardly facing ratchet teeth 80 defined or formed on an exterior side of the sidewall 44E between the top and bottom ends 44A, 44B of the column 44. The teeth 80 protrude outwardly therefrom.

Each hold-down unit 72 further includes a product hold down anchor 82. The hold down anchor 82 has a platen body 84 for resting on and support by the stack S of product items P and an one-way ratchet member 86 selectively engageable one at a time with and disengageable from a selected one of the projecting elements or teeth 80 in the vertical row 76 thereof. The platen body 84 of the hold down anchor 82 is of a predetermined size and configuration that approaches the cross-sectional size and configuration of the compartment 46 of the tubular column 44 so that the platen body 84 substantially occupies the cross-sectional space of the column 44 at the particular vertical level of the platen body 84 in the column 44. However, there is still sufficient clearance between the perimeter of the platen body 84 and the sidewalls 44D, 44E and rear wall 44F of the column 44 to easily enable the platen body 84 to be lowered into and lifted from the tubular column 44 through the top open end 44A thereof and rest on top of the stacked product items P in the vertical compartment 46 of the respective one column 44.

Figure 8:
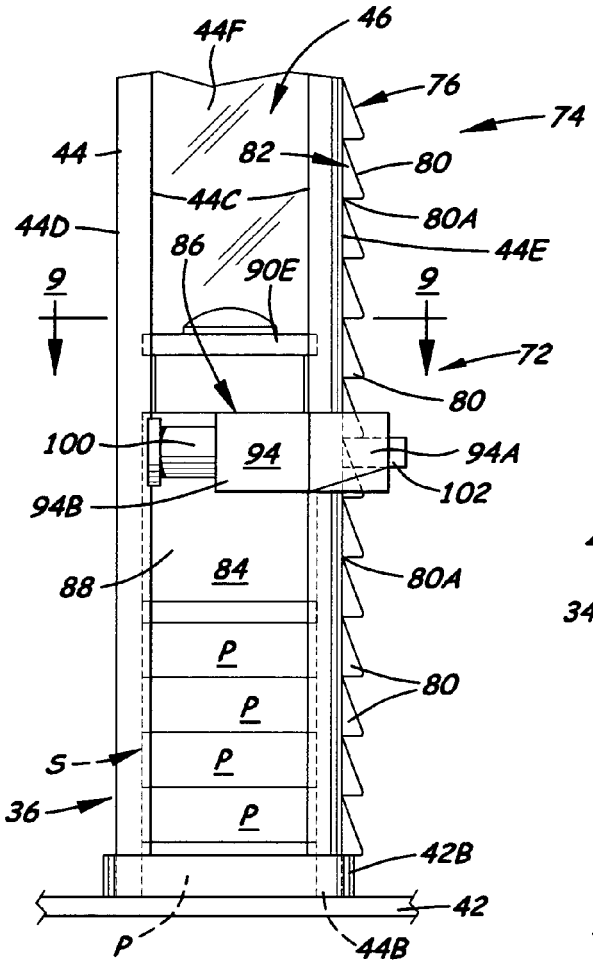
FIG. 8 is an enlarged fragmentary view of one exemplary embodiment of one of the plurality of hold down units of the product hold down mechanism of the present invention.
Figure 8A:
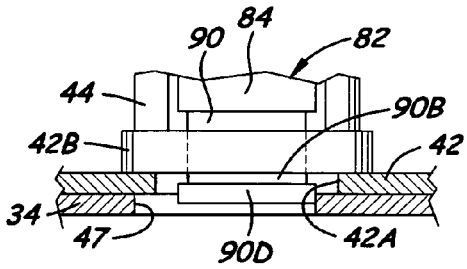
FIG. 8A is a view similar to that of FIG. 8 but now showing the position the hold down anchor of the unit when its column is empty of product items.
Figure 13:
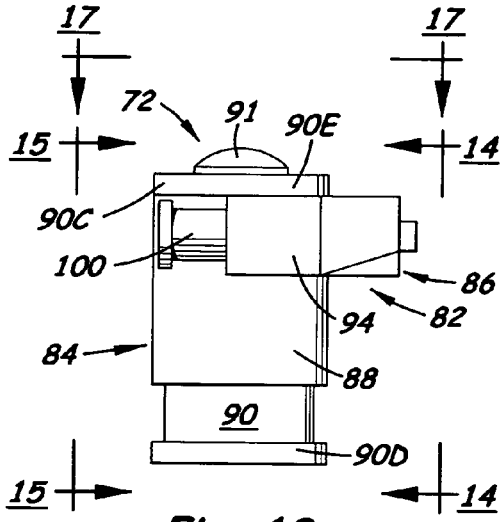
FIG. 13 is a front elevational view of the hold down anchor of the present invention.
Figure 14:
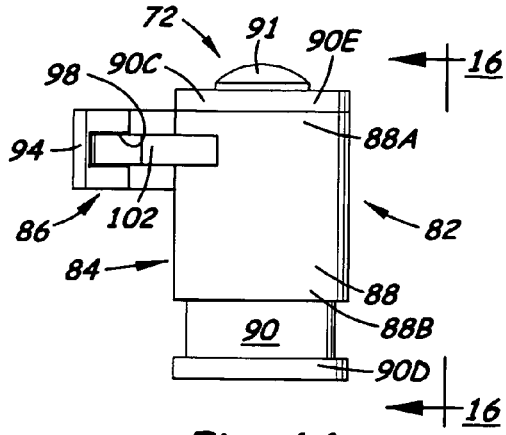
FIG. 14 is a right side elevational view of the anchor as seen along line 14-14 of FIG. 13.
Figure 15:
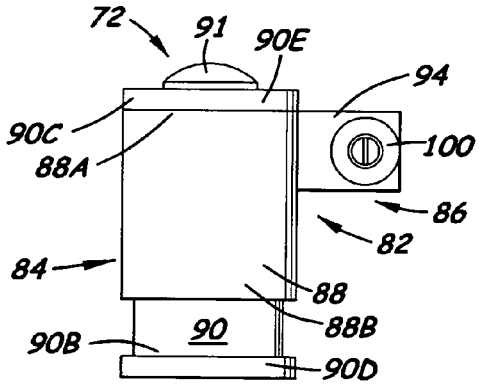
FIG. 15 is a left side elevational view of the anchor as seen along line 15-15 of FIG. 13.
Figure 16:
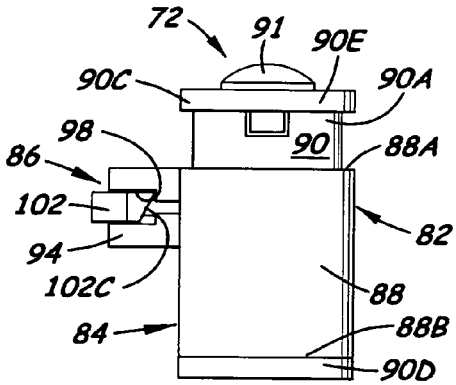
FIG. 16 is a back elevational view of the anchor of FIG. 13.
Figure 17:
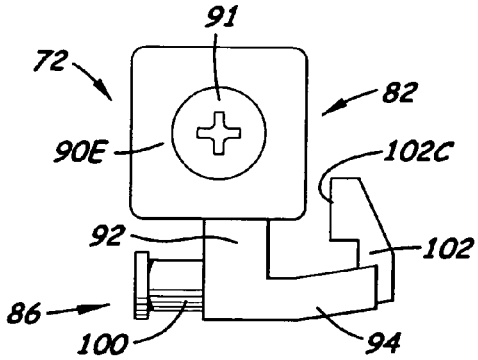
FIG. 17 is a top plan view of the anchor as seen along line 17-17 of FIG. 13.

More particularly, as best seen in FIGS. 13-17, the platen body 84 includes an outer tubular casing 88 having open upper and lower ends 88A, 88B, and an inner platen 90 reciprocally movably mounted in the outer tubular casing 88 and having opposite top and bottom ends 90A, 90B protrudable in opposite directions from the open top and bottom ends 44A, 44B of the outer tubular casing 88 such that, as seen in FIG. 8A, the bottom end 90B of the inner platen 90 can extend into a dispensing passage 47 in the platform 34 of the head 16 to cause termination of movement of the carousel 36 relative to the dispensing passage 47. The inner platen 90 also has peripheral rims 90C, 90D at its top and bottom ends 90A, 90B with the top peripheral rim 90C being formed on a cap 90E which is detachably attached to the inner platen 90 by a screw fastener 91 which permits assembling the inner platen 90 to the outer tubular casing 88. The peripheral rims 90C, 90D of the inner platen 90 will abut the upper and lower ends 88A, 88B of the outer tubular casing 88 so as to define the limits that the top and bottom ends 90A, 90B of the inner platen 90 can protrude from the upper and lower ends 88A, 88B of the outer tubular casing 88, as seen in FIG. 13.

Each one-way ratchet member 86 of the hold down anchor 82 has a base portion 92 fixedly connected the outer tubular casing 88 of a respective one platen body 84 and an arm portion 94 fixedly connected to the base portion 92. The base portion 92 is disposed through and protrudes outwardly from the slot 44C of the column 44 when the platen body 84 of the anchor 82 is lowered into or as it is moved vertically within the compartment 46 of the column 44. The arm portion 94 adjacent an inner end 94B thereof is fixedly connected to the base portion 92 and is disposed exteriorly of the column 44 when the platen body 84 of the anchor 82 is disposed in the compartment 46 and the base portion 92 is disposed in the slot 44C thereof. The arm portion 94 extends transversely relative to the base portion 92 so as to dispose an outer end 94A of the arm portion 94 adjacent to and generally aligned with the series of ratchet teeth 80 on the exterior side of the sidewall 44E of the column 44. The arm portion 94 has an open bore 96 extending through it from an inner end 94B to the outer end 94A thereof and a locking recess 98 defined in a side of its outer end 94A adjacent to the series of ratchet teeth 80.

Figure 9:
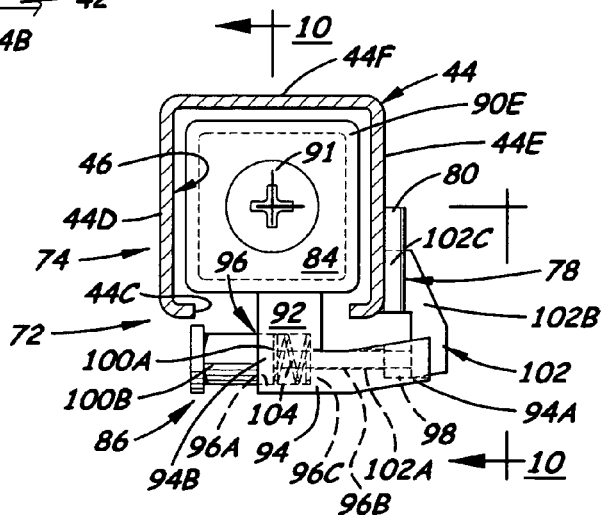
FIG. 9 is a cross sectional view taken along line 9-9 of FIG. 8 showing the hold down anchor in an engaged position with the vertical row of engageable elements on an outside surface of the column.

Each pivotal one-way ratchet member 86 of the hold down anchor 82 has an elongated pin shaft 100 fixedly connected to a handle 102 with both slidably mounted in the bore 96 of the arm portion 94. The handle 102 has an inner stem portion 102A and an outer head portion 102B. The outer head portion 102B defines a ratchet element 102C complementary in shape to the shape of a groove 80A for underlying each of the teeth 80 of the row 76 thereof for meshing with the groove 80A. The bore 96 has inner and outer bore sections 96A, 96B of different diameters, with the inner section 96A being larger than the outer section 96B such that a shoulder 96C is defined between the inner and outer bore sections 96A, 96B. The diameter of the pin shaft 100 is larger than the diameter of the inner stem portion 102A of the handle 102 such that a coil spring 104 of the ratchet member 88 is disposed about the inner stem portion 102A and captured between the inner end 100A of the pin shaft 100 and the shoulder 96C of the bore 96. Thus, the coil spring 104 biases the pin shaft 100 and the handle stem portion 102A to slide toward the inner end 94B of the arm portion 94 until an outer end 100B of the pin shaft 100 extends beyond the bore 96 at the inner end 94B of the arm portion 94, as seen in FIG. 9. The coil spring 104 is yieldable so as to allow the pin shaft 100 to be forceably moved against the bias of the coil spring 104 by manually pushing on the protruding outer end 100B of the pin shaft 100 toward the outer end 94A of the arm portion 94 until the outer head portion 102B of the handle 102 is disposed beyond the outer end 94A of the arm portion 94 and beyond the locking recess 98 therein, as seen in FIGS. 11 and 12.

Figure 10:
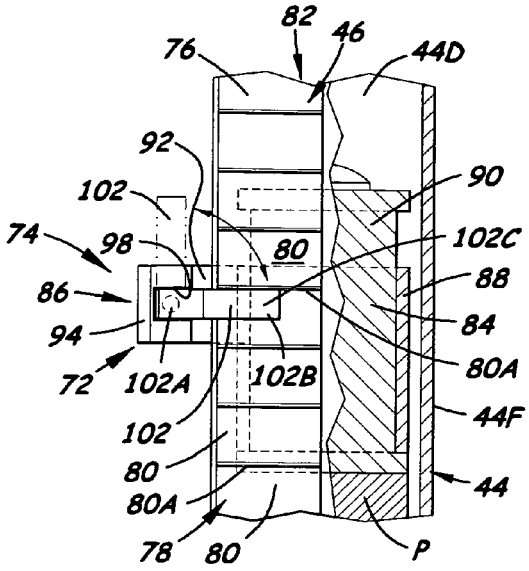
FIG. 10 is a fragmentary longitudinal sectional view taken along line 10-10 of FIG. 9 still showing the hold down anchor in the engaged position.

The outer head portion 102B of the handle 102 is fixedly attached to the inner stem portion 102A thereof and extends transversely thereto. The outer head portion 102B has the ratchet element 102C formed thereon complementary and matable with the groove 80A underlying each one of the ratchet teeth 80 on the column 44, as seen in FIGS. 9 and 10. When the outer head portion 102B is free of the locking recess 98, as seen in FIGS. 11 and 12, the handle 102 can be turned or pivoted away from the locking recess 98 to a disengaged position (seen in FIG. 12) where the manually applied force overcoming the biasing force of the coil spring 104 can be released and the outer head portion 102B allowed to rest against the outer end 94A of the arm portion 94 holding the handle 102 in a stationary orientation. With the outer head portion 102*b* in the disengaged position, the anchor 82 and its platen body 84 can easily be installed into and withdrawn from the column 44.

Figure 11:
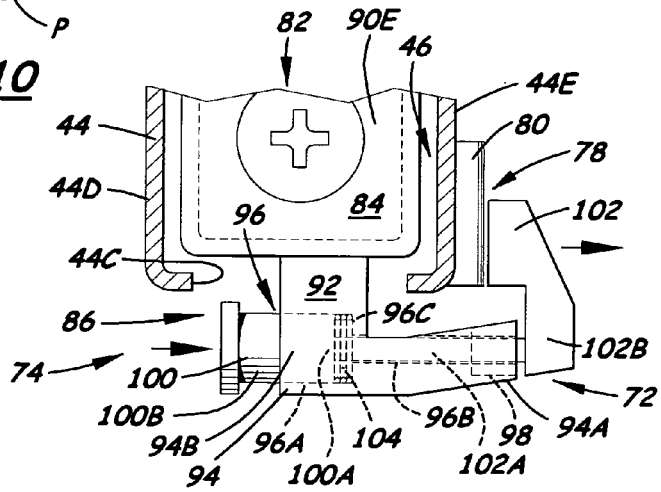
FIG. 11 is a view similar to that of FIG. 9 now showing the forward half thereof with the hold down anchor about midway in the process of being converted from the engaged position to a disengaged position relative to the vertical row of engageable elements
Figure 12:
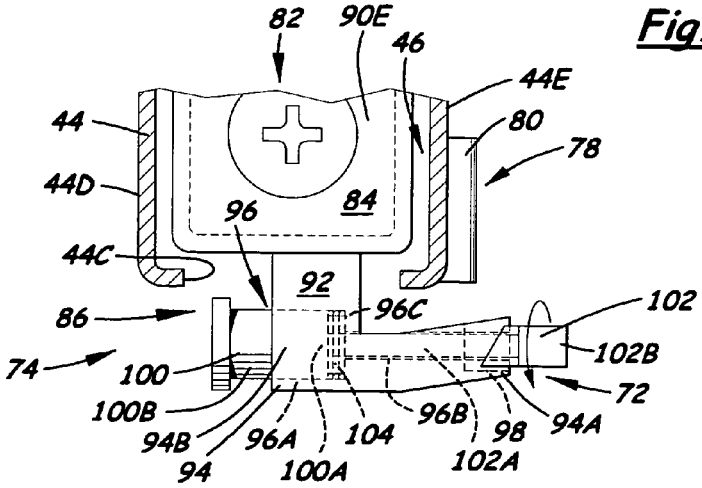
FIG. 12 is a view similar to that of FIG. 11 now showing the hold down anchor in the disengaged position.

Once the platen body 84 of the hold down anchor 82 is installed in the column 44, the outer head portion 102B can be turned or pivoted back toward the locking recess 98, as seen in FIG. 11, and then released so that the bias of the coin spring 104 will draw it into the locking recess 98 and retain it there extending laterally outward through the locking recess 98 with its ratchet element 102C in a meshing engagement with the adjacent one of the ratchet teeth 80 on the column 44, as seen in FIGS. 9 and 10. With the ratchet element 102C being retained by the bias of the coil spring 104 in the meshing engagement with the ratchet teeth 80, the configuration of the ratchet teeth 80 and the meshing engagement of the ratchet element 102C with the ratchet teeth 80 permits a one-way ratcheting movement of the platen body 84 downwardly along the column 44 until it reaches a resting position on the top of the stack S while preventing the moving or lifting of the platen body 84 upwardly along the column 44 without first moving the handle 102 to the disengaged position. In such manner, a plurality of hold down units 72 prevent dislodging of the items P from their respective stacks S in the columns 44 even if the vending machine is turned upside down and shook side-to-side by a vandal attempting to dislocate and dispense items P without insertion of any coins into the vending machine.

Figure 18:
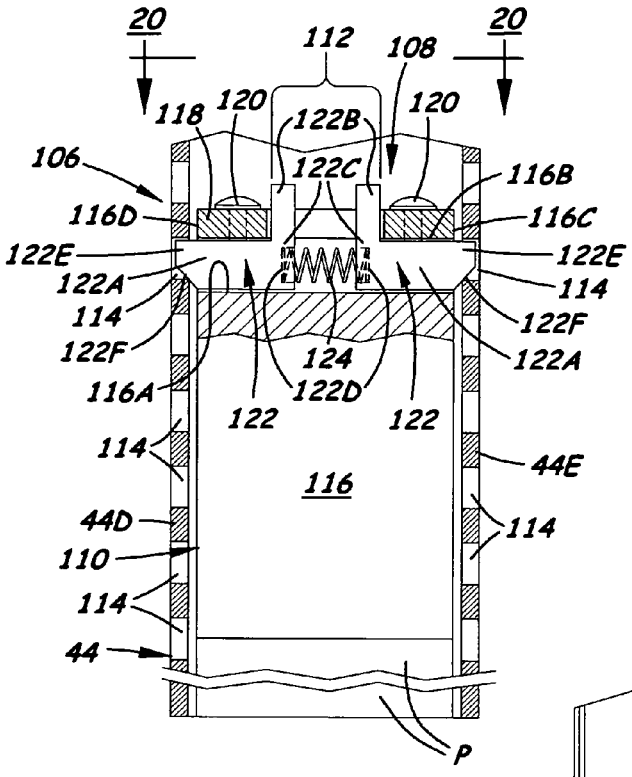
FIG. 18 is a vertical sectional view of a column of the carousel and an elevational view, partly sectioned, of another exemplary embodiment of the product hold down unit and anchor of the present invention.
Figure 19:
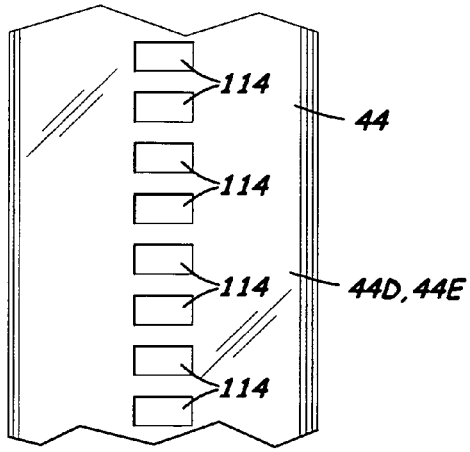
FIG. 19 is a fragmentary side elevational view of the column showing a vertical row of the engageable elements.
Figure 20:
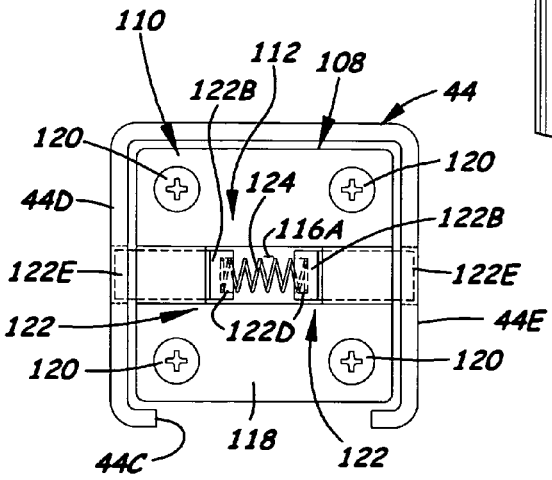
FIG. 20 is a top plan view of the unit and anchor as seen along line 20-20 of FIG. 18.

Turning now to FIGS. 18-20, there is shown another exemplary embodiment of the product hold down unit of the present invention, generally designated 106. The unit 106 includes the tubular storage column 44 of the carousel 36 having the plurality of tubular storage columns 44. The column 44 defines the vertical compartment 46 and is open at opposite top and bottom ends 44A, 44B and adapted to receive product items P in a vertical stack S therein. The column 44 has at least one and preferably a pair of vertical rows 76 of spaced apart engageable elements 78 defined on and extending between top and bottom ends 44A, 44B of tubular column 44, enabling restriction of product items P in the vertical stack S thereof in the compartment 46 to moving from the top end 44A toward the bottom end 44B of the compartment 46 but not vice versa.

The unit 106 also includes a hold down anchor 108 adapted to be lowered into the compartment 46 of the column 44 through the open top end 44A thereof and rest on top of and thereby be supported by the stack S of product items P in the vertical compartment 46 of the tubular column 44. The hold down anchor 108 also is adapted to engage selected engageable elements 78 in the vertical rows 76 thereof on the opposite sidewalls 44D, 44E of the column 44 that are adjacent to the hold down anchor 108 such that the hold down anchor 108 can move by gravity downward toward the bottom end 44B of the column 44 but not cannot move toward the top end 44A of the column 44.

More particularly, the hold down anchor 108 includes a platen body 110 for resting on and support by the stack S of product items P and an one-way ratchet member 112 coupled to the platen body 110. The one-way ratchet member 112 is selectively engageable with and disengageable from the selected engageable elements 78 in the vertical rows 76 thereof on the column 44. The engageable elements 78 take the form of vertically spaced-apart openings 114 formed in the opposite sidewalls 44D, 44E of the column 44. The platen body 110 has a main body portion 116 with an upper channel 116A formed in a top surface 116B of the main body portion 116 and extending transversely between opposite sides 116C, 116D thereof. The platen body 110 also has an upper end cap 118 fastened by screws 120 upon the top surface 116B of the main body portion 116 so as to cover the upper channel 116A. The upper end cap 118 has a central opening 118A through it which is rectangular-shaped and overlies a central portion of the channel 116A.

The one-way ratchet member 112 takes the form of at least one and preferably a pair of opposing latches 122 with slider portions 122A slidably mounted in the transverse channel 116A in the platen body 110 and handle portions 122B integrally connected to inner ends 122C of the slider portions 122A and extending vertically therefrom through the central opening 118A of and above the end cap 118. A biasing element in the form of a coil spring 124 is disposed between the inner ends 122C of the slider portions 122A with its opposite ends 124A seated within recesses 122D formed in the inner ends 122C of the slider portions 122A of the latches 122. The platen body 110 can be positioned within the column 44 such that the outer ends 122E of the slider portions 122A of the latches 122 will extend through a selected pair of the openings 114 in the opposite sidewalls 44D, 44F of the column 44. The lower edges 122F of the outer ends 122E of the latches 122 are inclined or beveled such that upon dispensing of a product item P from the stack S supporting the platen body 110, due to gravity alone the opposing latches 122 are forced to move inward toward one another allowing the platen body 110 to move downward with the stack S and engage into the next lower pair of openings 114 in the column 44. The handle portions 122B can be gripped and squeezed between a user's fingers or with a tool such as a needle-nosed plyers to move the latches 122 toward one another to insert the anchor downwardly into or remove it upwardly from the column 44.

Thus, it will be readily understood that the present invention contemplates product hold down anchors 82, 108 which are mounted in a self-contained manner by the columns 44 of the hold down unit 72, 106 and the stack S of product items P therein. The anchors 82, 108 include platen bodies 84, 110 with one-way ratchet members 86, 112 which are engageable with respective selected ones of engageable elements 78, 114 provided on the columnns 44 so as to be accessible from externally and internally of the columns 44 by the one-way ratchet members 86, 112.

It is thought that the present invention and its advantages will be understood from the foregoing description and it is apparent that various changes may be made without departing from the spirit and scope of the invention or sacrificing its material advantages, the forms hereinbefore described being merely preferred or exemplary embodiments.

The invention claimed is:

1. A hold down anchor for a merchandise storing and dispensing head of a vending machine, said anchor comprising:

a platen body adapted to be lowered into a compartment of a tubular storage column through an open top end thereof and rest on top of and be supported by a stack of product items in the vertical compartment of the tubular column; and an one-way ratchet member coupled to said platen body and selectively engageable with and disengageable from a selected engageable element in at least one vertical row thereof on the tubular column that are adjacent to said platen body allowing said hold down anchor to move by gravity downward toward a bottom end of the column but not move toward the top end of the column, said one-way ratchet member including a base fixedly connected to said platen body and disposed through and protruding outwardly from a longitudinal vertical slot in said tubular column, an arm extending transversely of and fixedly connected to said base and disposed exteriorly of said tubular column so as to dispose an outer end of said arm adjacent to and aligned with said vertical row of downwardly and outwardly projecting elements on an exterior surface of said tubular column, an elongated pin slidably mounted through a bore of said arm and having opposite first and second ends disposed adjacent an inner end and said outer end of said arm, a spring in said bore of said arm engaging said pin so as to bias said pin to slide toward said inner end of said arm until said first end of said pin extends beyond said bore at said inner end of said arm, said spring being yieldable so as to allow said pin to be forceably moved against the bias of said spring by pushing on said first end of said pin toward said outer end of said arm until said second end of said pin extends beyond said bore at said outer end of said arm, and a ratchet element fixedly attached to said second end of said pin and extending transversely thereto, said ratchet element having a ratchet tooth formed thereon complementary and matable with one of said projecting elements on said column when said ratchet element is in an engaged position in which it extends through a recess at said outer end of said arm into meshing engagement with one of said projecting elements on said column, said ratchet element being retained by the bias of said spring in said engaged position and meshing engagement with said one element on said column, said meshing engagement between said ratchet and projecting elements permitting one-way ratcheting movement of said platen body by gravity downwardly along said column until it reaches a rest position on the top of the stack but preventing movement said platen body upwardly along said column, said ratchet element being moveable between said engaged position to a disengaged position away from said column by moving said pin against its bias toward said outer end of said arm until said ratchet element is clear of said recess at said outer end of said arm and then rotating said ratchet element in a direction away from said column and past said recess at said outer end of said arm such that when said ratchet element is in said disengaged position said platen body may be lowered into or lifted from said compartment of said tubular column.

2. The anchor of claim 1 wherein said platen body includes:

an outer tubular casing having open upper and lower ends; and an inner platen reciprocally movable mounted in said outer tubular casing and having opposite top and bottom ends protrudable in opposite directions from said open upper and lower ends of said outer tubular casing such that said bottom end of said inner platen can extend into a dispensing opening in the head to cause termination of movement of the carousel relative to the dispensing opening.

3. A product hold down unit for a merchandise storing and dispensing head of a vending machine, said unit comprising:

a tubular storage column of a carousel having a plurality of tubular storage columns, said column defining a vertical compartment and being open at opposite top and bottom ends of said column and adapted to receive product items in a vertical stack in said compartment, said column also having a longitudinal vertical slot therein;

at least one vertical row of spaced apart engageable elements defined on an exterior surface of said tubular column and extending between said top and bottom ends of said tubular column, enabling restriction of product items in the vertical stack thereof in said compartment to moving from said top end toward said bottom end of said compartment but not vice versa; and a hold down anchor having a platen body and a one-way ratchet member coupled to said platen body, said ratchet member extending outwardly through said vertical slot of said column to adjacent said vertical row of engageable elements on said exterior surface of said column and engageable with and disengageable from selected engageable elements in said vertical row thereof, said hold down anchor adapted to be lowered into said compartment of said tubular storage column through said open top end thereof such that said platen body rests on top of and thereby is supported by the stack of product items in said vertical compartment of said tubular column as said one-way ratchet member extending from said vertical compartment of said tubular column through said vertical slot to exteriorly thereof engages said selected engageable elements in said vertical row thereof such that said hold down anchor can move by gravity downward toward said bottom end of said column but not cannot move toward said top end of said column;

wherein said platen body of said hold down anchor includes an outer tubular casing having open upper and lower ends, and an inner platen reciprocally movable mounted in said outer tubular casing and having opposite top and bottom ends protrudable in opposite directions from said open upper and lower ends of said outer tubular casing such that said bottom end of said inner platen can extend into a dispensing opening in the head to cause termination of movement of the carousel relative to the dispensing opening.

4. The unit of claim 3 wherein said one-way ratchet member includes:

a base fixedly connected to said platen body and disposed through and protruding outwardly from said longitudinal vertical slot in said tubular column;

an arm extending transversely of and fixedly connected to said base and disposed exteriorly of said tubular column so as to dispose an outer end of said arm adjacent to and aligned with said vertical row of downwardly and outwardly projecting elements on said exterior surface of said tubular column;

an elongated pin slidably mounted through a bore of said arm and having opposite first and second ends disposed adjacent an inner end and said outer end of said arm;

a spring in said bore of said arm engaging said pin so as to bias said pin to slide toward said inner end of said arm until said first end of said pin extends beyond said bore at said inner end of said arm, said spring being yieldable so as to allow said pin to be forceably moved against the bias of said spring by pushing on said first end of said pin toward said outer end of said arm until said second end of said pin extends beyond said bore at said outer end of said arm; and a ratchet element fixedly attached to said second end of said pin and extending transversely thereto, said ratchet element having a ratchet tooth formed thereon complementary and matable with one of said engageable elements on said exterior of said column when said ratchet element is in an engaged position in which it extends through a recess at said outer end of said arm into meshing engagement with one of said engageable elements on said column, said ratchet element being retained by the bias of said spring in said engaged position and meshing engagement with said one engageable element on said column, said meshing engagement between said ratchet and engageable elements permitting one-way ratcheting movement of said platen body by gravity downwardly along said column until it reaches a rest position on the top of the stack but preventing movement said platen body upwardly along said column, said ratchet element being moveable between said engaged position to a disengaged position away from said column by moving said pin against its bias toward said outer end of said arm until said ratchet element is clear of said recess at said outer end of said arm and then rotating said ratchet element in a direction away from said column and past said recess at said outer end of said arm such that when said ratchet element is in said disengaged position said platen body may be lowered into or lifted from said compartment of said tubular column.

5. The unit of claim 4 wherein said vertical row of engageable elements is a vertical row of spaced apart teeth formed on said exterior surface of said column and engageable with and disengageable from said ratchet element on said one-way ratchet member.

6. A product hold down mechanism for a merchandise storing and dispensing head of a vending machine, said mechanism comprising:

a plurality of tubular storage columns of a carousel of a merchandise storing and dispensing head, each of said columns defining a vertical compartment and being open at opposite top and bottom ends of said column and adapted to receive product items in a vertical stack in said compartment, each of said columns also having a longitudinal vertical slot therein; and a plurality of product hold down units each associated with one of said plurality of tubular storage columns of said carousel, each of said units including at least one vertical row of spaced apart engageable elements defined on an exterior surface of said one tubular column and extending between said top and bottom ends of said one tubular column, enabling restriction of product items in the vertical stack thereof in said compartment to moving from said top end toward said bottom end of said compartment but not vice versa, said each of said plurality of product hold down units also includes a hold down anchor having a platen body and a one-way ratchet member coupled to said platen body, said ratchet member extending outwardly through said vertical slot of said column to adjacent said vertical row of engageable elements on said exterior surface of said column and engageable with and disengageable from selected engageable elements in said vertical row thereof, said hold down anchor adapted to be lowered into said compartment of said tubular storage column through said open top end thereof such that said platen body rests on top of and thereby be supported by the stack of product items in said vertical compartment of said tubular column as said one-way ratchet member extending from said vertical compartment of said tubular column through said vertical slot to exteriorly thereof engages said selected engageable elements in said vertical row thereof such that said hold down anchor can move by gravity downward toward said bottom end of said column but not cannot move toward said top end of said column;

wherein said platen body of said hold down anchor includes an outer tubular casing having open upper and lower ends, and an inner platen reciprocally movable mounted in said outer tubular casing and having opposite top and bottom ends protrudable in opposite directions from said open upper and lower ends of said outer tubular casing such that said bottom end of said inner platen can extend into a dispensing opening in the head to cause termination of movement of the carousel relative to the dispensing opening.

7. The mechanism of claim 6 wherein said one-way ratchet member includes:

a base fixedly connected to said platen body and disposed through and protruding outwardly from said longitudinal vertical slot in said tubular column;

an arm extending transversely of and fixedly connected to said base and disposed exteriorly of said tubular column so as to dispose an outer end of said arm adjacent to and aligned with said vertical row of downwardly and outwardly projecting elements on said exterior surface of said tubular column;

an elongated pin slidably mounted through a bore of said arm and having opposite first and second ends disposed adjacent an inner end and said outer end of said arm;

a spring in said bore of said arm engaging said pin so as to bias said pin to slide toward said inner end of said arm until said first end of said pin extends beyond said bore at said inner end of said arm, said spring being yieldable so as to allow said pin to be forceably moved against the bias of said spring by pushing on said first end of said pin toward said outer end of said arm until said second end of said pin extends beyond said bore at said outer end of said arm; and a ratchet element fixedly attached to said second end of said pin and extending transversely thereto, said ratchet element having a ratchet tooth formed thereon complementary and matable with one of said engageable elements on said exterior surface of said column when said ratchet element is in an engaged position in which it extends through a recess at said outer end of said arm into meshing engagement with one of said engageable elements on said column, said ratchet element being retained by the bias of said spring in said engaged position and meshing engagement with said one engageable element on said column, said meshing engagement between said ratchet and engageable elements permitting one-way ratcheting movement of said platen body by gravity downwardly along said column until it reaches a rest position on the top of the stack but preventing movement said platen body upwardly along said column, said ratchet element being moveable between said engaged position to a disengaged position away from said column by moving said pin against its bias toward said outer end of said arm until said ratchet element is clear of said recess at said outer end of said arm and then rotating said ratchet element in a direction away from said column and past said recess at said outer end of said arm such that when said ratchet element is in said disengaged position said platen body may be lowered into or lifted from said compartment of said tubular column.

8. The unit of claim 7 wherein said vertical row of engageable elements is a vertical row of spaced apart teeth formed on said exterior surface of said column and engageable with and disengageable from said ratchet element on said one-way ratchet member.

* * * * *